US011313238B2

(12) United States Patent
Kim

(10) Patent No.: US 11,313,238 B2
(45) Date of Patent: Apr. 26, 2022

(54) TURBINE BLADE INCLUDING PIN-FIN ARRAY

(71) Applicant: DOOSAN HEAVY INDUSTRIES & CONSTRUCTION CO., LTD., Changwon-si (KR)

(72) Inventor: Ki Baek Kim, Changwon-si (KR)

( * ) Notice: Subject to any disclaimer, the term of this patent is extended or adjusted under 35 U.S.C. 154(b) by 146 days.

(21) Appl. No.: 16/508,301

(22) Filed: Jul. 11, 2019

(65) Prior Publication Data

US 2020/0095870 A1 Mar. 26, 2020

(30) Foreign Application Priority Data

Sep. 21, 2018 (KR) ..... 10-2018-0114222

(51) Int. Cl.
*F01D 5/18* (2006.01)

(52) U.S. Cl.
CPC ..... *F01D 5/187* (2013.01); *F05B 2260/2241* (2013.01); *F05D 2210/33* (2013.01); *F05D 2240/304* (2013.01); *F05D 2240/305* (2013.01); *F05D 2250/32* (2013.01); *F05D 2260/2212* (2013.01); *F05D 2260/22141* (2013.01)

(58) Field of Classification Search
CPC ..... F01D 5/187; F05B 2260/2241; F05D 2240/304; F05D 2250/32; F05D 2260/22141
See application file for complete search history.

(56) References Cited

U.S. PATENT DOCUMENTS 4,278,400 A 7/1981 Yamarik et al.
4,474,532 A 10/1984 Pazder
7,938,624 B2 * 5/2011 Tibbott ..... F23R 3/002 416/96 R
8,668,453 B2 3/2014 Lee et al.
(Continued)

FOREIGN PATENT DOCUMENTS

CN 103119247 A 5/2013
EP 1849960 A2 * 10/2007 ..... F01D 9/041
(Continued)

OTHER PUBLICATIONS

First Office Action & Search Report in Chinese dated Oct. 9, 2021.

*Primary Examiner* — Christopher R Legendre
(74) *Attorney, Agent, or Firm* — Harvest IP Law, LLP

(57) ABSTRACT

A turbine blade includes a blade extending from a platform to a free end and having an airfoil-shaped cross section, the blade including a leading edge, a trailing edge, a pressure side extending from the leading edge to the trailing edge, and a suction side extend-ing from the leading edge to the trailing edge, one or more internal cooling passages through which cooling air flows, a trailing edge slot formed along the trailing edge and con-nected to the internal cooling passage, and a pin-fin array including a plurality of pin-fins positioned in the internal cooling passage connected to the trailing edge slot, each pin-fin including a main body and chamfered or filleted portions respectively connected to the pressure side and the suction side at respective ends of the main body, wherein among the pin-fins of the pin-fin array, a portion of the pin-fins have relatively large chamfered or filleted portions as compared with remaining pin-fins.

8 Claims, 7 Drawing Sheets

(56) References Cited

U.S. PATENT DOCUMENTS

| | | | | |
|---|---|---|---|---|
| 9,297,261 | B2 * | 3/2016 | Otero | F01D 5/187 |
| 10,655,476 | B2 * | 5/2020 | Halfmann | F01D 5/187 |
| 2013/0232991 | A1 | 9/2013 | Otero | |
| 2015/0118064 | A1 | 4/2015 | Levine | |
| 2016/0333699 | A1 * | 11/2016 | Downey, Jr. | F01D 5/18 |
| 2020/0095870 | A1 * | 3/2020 | Kim | F01D 5/187 |

FOREIGN PATENT DOCUMENTS

| | | | |
|---|---|---|---|
| KR | 1020050061304 | A | 6/2005 |
| KR | 101580490 | B1 | 12/2015 |

* cited by examiner

TURBINE BLADE INCLUDING PIN-FIN ARRAY

CROSS REFERENCE TO RELATED APPLICATION

This application claims priority to Korean Patent Application No. 10-2018-0114222, filed on Sep. 21, 2018, the entire disclosure of which is incorporated herein by reference in its entirety.

BACKGROUND

1. Field

Apparatuses and methods consistent with exemplary embodiments relate to a turbine blade of a gas turbine and, more particularly, to a turbine blade having a pin-fin array improving mechanical strength at a trailing edge.

2. Description of the Related Art

A turbine is a mechanical device for obtaining torque from an impulse force or a reaction force generated by a flow of compressible fluid such as steam and gas. Turbines may include steam turbines using steam as the compressible fluid and gas turbines using hot combustion gas as the compressible fluid.

A gas turbine includes a compressor section, a combustor section, and a turbine section. The compressor section includes a plurality of compressor vanes and a plurality of compressor blades alternately arranged in a compressor casing with an air inlet through which air is introduced. The introduced air is compressed through the rotary compressor blades up to a target pressure.

The combustor section supplies fuel to the compressed air compressed by the compressor section and ignites a fuel-air mixture with a burner to produce a high temperature and high-pressure combustion gas.

The turbine section includes a plurality of turbine vanes and a plurality of turbine blades alternately arranged in a turbine casing. A rotor extends through the centers of the compressor section, the combustor section, the turbine section, and an exhaust chamber.

The rotor is rotatably supported by bearings at respective axial ends thereof. A plurality of disks are installed on the rotor so that a plurality of blades can be coupled thereto. An end of the rotor, which is on the exhaust chamber side, is connected to a drive shaft of an electric generator or like.

A gas turbine does not have a reciprocating mechanism such as a piston which is usually provided in a typical four-stroke engine. That is, the gas turbine has no mutual frictional part such as a piston-cylinder part, thereby having the advantages that consumption of lubricating oil is extremely small and an operational stroke which is relatively long in common reciprocating mechanisms is reduced. Therefore, the gas turbine has an advantage of high operation speed.

There are various factors affecting the efficiency of a gas turbine. Recent development in the field of gas turbines has progressed in various aspects such as an improvement in combustion efficiency of a combustor, an improvement in thermodynamic efficiency through increase of a turbine inlet temperature, and an improvement in aerodynamic efficiency of a compressor and a turbine.

Industrial gas turbines for power generation can be classified into various classes according to the turbine inlet temperature (TIT). Currently, G- and H-class gas turbines are dominant. Recently, some latest gas turbines have been found to reach J-class. The higher the class of the gas turbine, the higher the turbine efficiency and the turbine inlet temperature. For an H-class gas turbine, the development of heat-resistant materials and the development of cooling technology are required because the H-class gas turbine has the turbine inlet temperature of about 1500° C.

Considering that the turbine inlet temperature is getting higher, various cooling technologies are being used to ensure the heat resistance performance of turbine blades. In the cooling structure of the turbine blade, cooling air in an internal cooling passage of the turbine blade is ejected to cause an impingement cooling, and various types of outlets are disposed in several places to form an effective film cooling on the surface. However, there is difficulty in applying those cooling methods because the trailing edge of the turbine blade is structurally weak due to the airfoil shape. In addition, if a cooling slot formed at the trailing edge to eject the cooling air to the outside is increased in size to improve cooling performance, the structural strength of the trailing edge becomes more problematic.

In addition, because a turbine blade continues to be under dynamic pressure fluctuating due to changes in temperature and pressure of flowing combustion gas, and is continuously exposed to the high temperature of combustion gas, material properties of the turbine blade are deteriorated and the mechanical strength of the turbine blade is inevitably deteriorated. This problem is serious at the mechanically weakest trailing edge of the turbine due to the airfoil shape, so the improvement in structural strength of the trailing edge is important in the design of the turbine blade.

SUMMARY

Aspects of one or more exemplary embodiments provide a turbine blade having a novel structure capable of improving the cooling performance and mechanical strength of a trailing edge with minimal design changes.

Additional aspects will be set forth in part in the description which follows and, in part, will become apparent from the description, or may be learned by practice of the exemplary embodiments.

According to an aspect of an exemplary embodiment, there is provided a turbine blade including: a blade extending from a platform to a free end and having an airfoil-shaped cross section, the blade including a leading edge, a trailing edge, a pressure side extending from the leading edge to the trailing edge, a suction side extending from the leading edge to the trailing edge, one or more internal cooling passages through which cooling air flows, a trailing edge slot formed along the trailing edge and connected to the internal cooling passage, and a pin-fin array including a plurality of pin-fins arranged in the internal cooling passage connected to the trailing edge slot, each pin-fin including a main body and chamfered or filleted portions respectively connected to the pressure side and the suction side at respective ends of the main body, wherein among the pin-fins of the pin-fin array, a portion of the pin-fins have relatively large chamfered or filleted portions as compared with remaining pin-fins.

The portion of the pin-fins having relatively large chamfered or filleted portions may be positioned in an inner corner region in which an inside wall surface of the internal cooling passage and an extended line of an upper end of the platform cross each other.

Each of the pin-fins having the relatively large chamfered or filleted portions positioned has a main body having the same diameter as the remaining pin-fins.

The turbine blade may further include a fillet formed along a joint line between the blade and the platform.

A pin-fin positioned closest to a boundary between the fillet and the blade and closest to the inside wall surface of the internal cooling passage may be determined as a first priority pin-fin to have the relatively large chamfered or filleted portions.

A pin-fin positioned directly above the first priority pin-fin may be determined as a second priority pin-fin to have the relatively large chamfered or filleted portions.

A pin-fin positioned directly below the first priority pin-fin may be determined as a third priority pin-fin to have the relatively large chamfered or filleted portions.

When the first through third priority pin-fins are arranged on a first column, among the pin-fins arranged on a second column close to the trailing edge, a pin-fin closest to the first priority pin-in or the boundary of the fillet may be determined as a fourth priority pin-fin to have the relatively large chamfered or filleted portions.

Among the pin-fins arranged on the second column, a pin-fin positioned directly above the fourth priority pin-fin may be determined as a fifth priority pin-fin to have the relatively large chamfered or filleted portions.

One to fourth pin-fins adjacent to the first priority pin-fin may be formed to have the relatively large chamfered or filleted portions.

According an aspect of another exemplary embodiment, there is provided a pin-fin array including: a plurality of pin-fins arranged in a trailing edge slot connected to an internal cooling passage of a turbine blade, each pin-fin being connected to a pressure side and a suction side at respective ends thereof, wherein a portion of the pin-fins have relatively large chamfered or filleted portions as compared with remaining pin-fins.

The portion of the pin-fins having relatively large chamfered or filleted portions may be positioned in a corner region in which an inside wall surface of the internal cooling passage and an extended line of an upper end of the platform cross each other.

By changing the supporting structure of only the pin-fins positioned in a predetermined corner region among the pin-fins of the pin-fin array positioned in the internal cooling passage connected to the trailing edge slot, it is possible to improve the mechanical strength of the trailing edge of the turbine blade.

Because the supporting structures are changed for only part of the pin-fins positioned in the predetermined corner region among the all of the pin-fins of the pin-fin array, design changes are minimized. In addition, because the arrangement of the pin-fins is maintained as it is, the effect of the design changes on the cooling performance is not significant.

Accordingly, the exemplary embodiment has an advantage of being applicable to a pre-designed turbine blade.

BRIEF DESCRIPTION OF THE DRAWINGS

The above and other aspects will be more apparent from the following description of the exemplary embodiments with reference to the accompanying drawings, in which.

DETAILED DESCRIPTION

Figure 1:
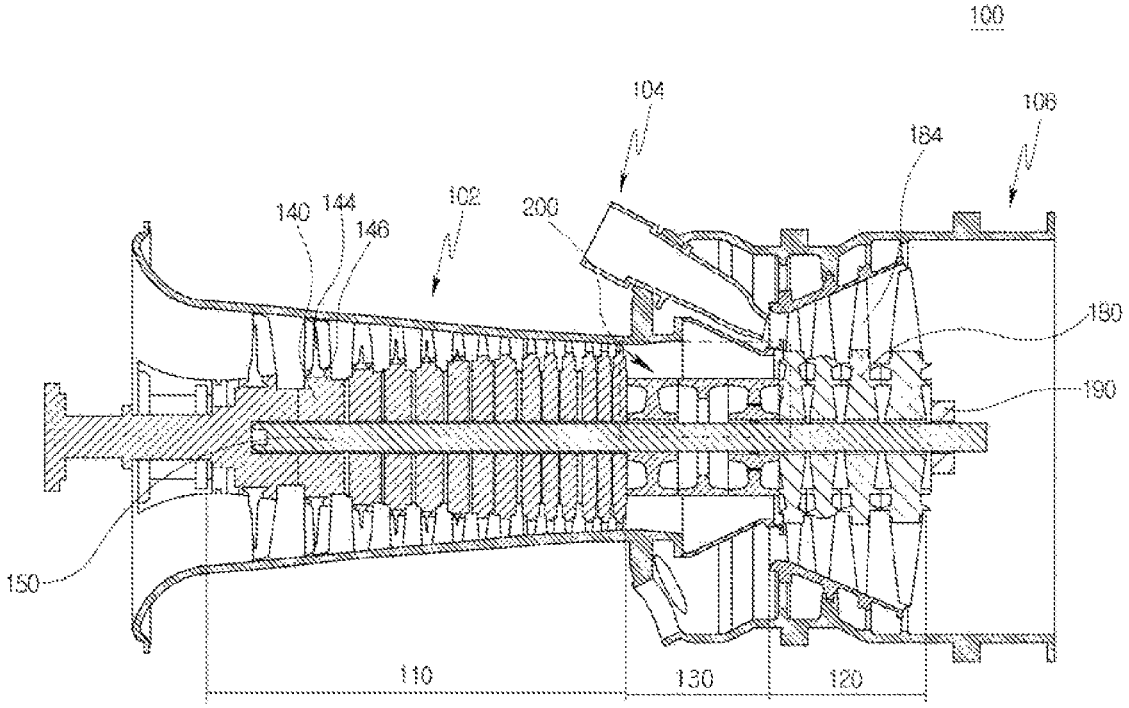
FIG. 1 is a cross-sectional view schematically illustrating the structure of a gas turbine according to an exemplary embodiment.

Various modifications may be made to the embodiments of the disclosure, and there may be various types of embodiments. Thus, specific embodiments will be illustrated in drawings, and embodiments will be described in detail in the description. However, it should be noted that the various embodiments are not for limiting the scope of the disclosure to a specific embodiment, but they should be interpreted to include all modifications, equivalents or alternatives of the embodiments included in the ideas and the technical scopes disclosed herein. Meanwhile, in case it is determined that in describing the embodiments, detailed explanation of related known technologies may unnecessarily confuse the gist of the disclosure, the detailed explanation will be omitted.

The terminology used herein is for the purpose of describing particular embodiments only and is not intended to limit the scope of the disclosure. As used herein, the singular forms "a", "an", and "the" are intended to include the plural forms as well unless the context clearly indicates otherwise. Further, the terms "comprises", "includes", or "have/has" should be construed as designating that there are such features, regions, integers, steps, operations, elements, components, and/or a combination thereof in the specification, not to exclude the presence or possibility of adding one or more of other features, regions, integers, steps, operations, elements, components and/or combinations thereof.

Further, terms such as "first," "second," and so on may be used to describe a variety of elements, but the elements should not be limited by these terms. The terms are used simply to distinguish one element from other elements. The use of such ordinal numbers should not be construed as limiting the meaning of the term. For example, the components associated with such an ordinal number should not be limited in the order of use, placement order, or the like. If necessary, each ordinal number may be used interchangeably.

Hereinbelow, exemplary embodiments will be described in detail with reference to the accompanying drawings. In order to clearly illustrate the disclosure in the drawings, some of the elements that are not essential to the complete understanding of the disclosure may be omitted, and like reference numerals refer to like elements throughout the specification.

FIG. 1 is a cross-sectional view illustrating a schematic structure of a gas turbine 100 according to an exemplary embodiment. Referring to FIG. 1, the gas turbine 100 includes a housing 102 and a diffuser 106 which is disposed on a rear end of the housing 102 and through which combustion gas passing through a turbine section is discharged. A combustor 104 for burning compressed air is disposed in front of the diffuser 106.

Based on the direction of an air flow, a compressor section 110 is located at an upstream side and a turbine section 120 is located at a downstream side. A torque tube 130 serving as a torque transfer member for transferring the torque generated in the turbine section 120 to the compressor section 110 is disposed between the compressor section 110 and the turbine section 120.

The compressor section 110 includes a plurality of compressor rotor disks 140, each of which is fastened by a tie rod 150 to prevent axial separation in an axial direction of the tie rod 150.

For example, the compressor rotor disks 140 are arranged in the axial direction in a state in which the tie rod 150 extends through the central holes of the compressor rotor disks 140. Here, adjacent compressor rotor disks 140 are arranged so that opposing surfaces thereof are in tight contact with each other by being pressed by the tie rod 150. The adjacent compressor rotor disks 140 cannot rotate because of this arrangement.

A plurality of compressor blades 144 are radially coupled to an outer circumferential surface of each of the compressor rotor disks 140. Each of the compressor blades 144 has a root member 146 so that each compressor blade 144 can be coupled to the compressor rotor disk 140 by the root member 146.

A plurality of compressor vanes fixed to an inner circumferential surface of the housing 102 are positioned between each of the compressor rotor disks 140. While the compressor rotor disks 140 rotate along with a rotation of the tie rod 150, the compressor vanes fixed to the housing 102 do not rotate. The compressor vanes guide the flow of the compressed air moved from front-stage compressor blades 144 to rear-stage compressor blades 144.

There are two coupling types for the root member 146: a tangential type and an axial type. Any one of the coupling types is selected according to the structure of a gas turbine. The root member 146 may have a dove tail structure or a fir-tree structure. In some cases, the compressor blades 144 may be coupled to the compressor rotor disks 140 by using other types of coupling members, such as, a key or a bolt.

The tie rod 150 is installed to extend through the center of the compressor rotor disks 140. An end of the tie rod 150 is fixed in the most upstream compressor rotor disk and the other end is fixed in the torque tube 130.

It is understood that the type of the tie rod 150 may not be limited to the example illustrated in FIG. 1, and may be changed or vary according to one or more other exemplary embodiments. For example, there are three types of tie rods: a single-type in which a single tie rod extends through the center of the compressor rotor disks; a multi-type in which multiple tie rods are arranged in a circumferential direction; and a complex type in which the single-type and the multi-type are combined.

Also, a deswirler is installed at the rear stage of the diffuser 106 of the compressor section 110. The deswirler is a guide vane configured to control an actual inflow angle of fluid entering into an inlet of the combustor so that the actual inflow angle matches the designed inflow angle. The combustor 104 mixes the introduced compressed air with fuel, burns the fuel-air mixture to produce high-temperature and high-pressure combustion gas, and increases the temperature of the combustion gas to a temperature at which the combustor and the turbine are able to be resistant to heat through an isobaric combustion process.

A plurality of combustors constituting the combustor 104 are disposed in a form of a cell in a casing. Each combustor includes a burner having a fuel injection nozzle and the like, a combustor liner defining a combustion chamber, and a transition piece serving as a connector between the combustor and the turbine.

The combustor liner provides a combustion space in which the fuel injected through the fuel injection nozzle and the compressed air supplied from the compressor section are mixed and burned. The combustor liner includes a flame tube providing the combustion space in which the fuel-air mixture is burned and a flow sleeve that surrounds the flame tube to provide an annular space between the flow sleeve and the flame tube. The fuel nozzle is coupled to a front end of the combustor liner, and a spark igniter plug is coupled to a side surface of the combustor liner.

The transition piece is connected to a rear end of the combustor liner to deliver the combustion gas toward the turbine section. The transition piece is configured such that an outer wall surface thereof is cooled by the compressed air supplied from the compressor section. Therefore, it is possible to prevent the transition piece from being damaged by the high temperature combustion gas.

To this end, the transition piece is provided with cooling holes through which the compressed air is injected, and the compressed air cools the inside of the transition piece and flows toward the combustor liner.

The compressed air that has cooled the transition piece flows into an annulus space of the combustor liner, and is supplied as a cooling air to an outer wall of the combustor liner from an outside of a flow sleeve through the cooling holes formed in the flow sleeve to collide with the cooling air.

The high-temperature and high-pressure combustion gas ejected from the combustor 104 is supplied to the turbine section 120. The supplied high-temperature and high-pressure combustion gas expands and provides a reaction force or impulse force to the turbine blades of the turbine section to generate a torque. A portion of the torque is transmitted to the compressor section 110 via the torque tube 130, and the remaining portion which is the excessive torque is used to drive an electric generator or the like.

The turbine section 120 is basically similar in structure to the compressor section 110. That is, the turbine section 120 may include a plurality of turbine rotor disks 180 similar to the compressor rotor disks 140 of the compressor section 110, and the turbine rotor disk 180 may include a plurality of turbine blades 184 disposed radially. For example, the turbine blades 184 may be coupled to the turbine rotor disk 180 in a dovetail coupling manner. In addition, turbine vanes fixed to the inner circumferential surface of the housing 102 are provided between the turbine blades 184 of the turbine rotor disks 180 to control a flow direction of the combustion gas passing through the turbine blades 184.

Figure 2:
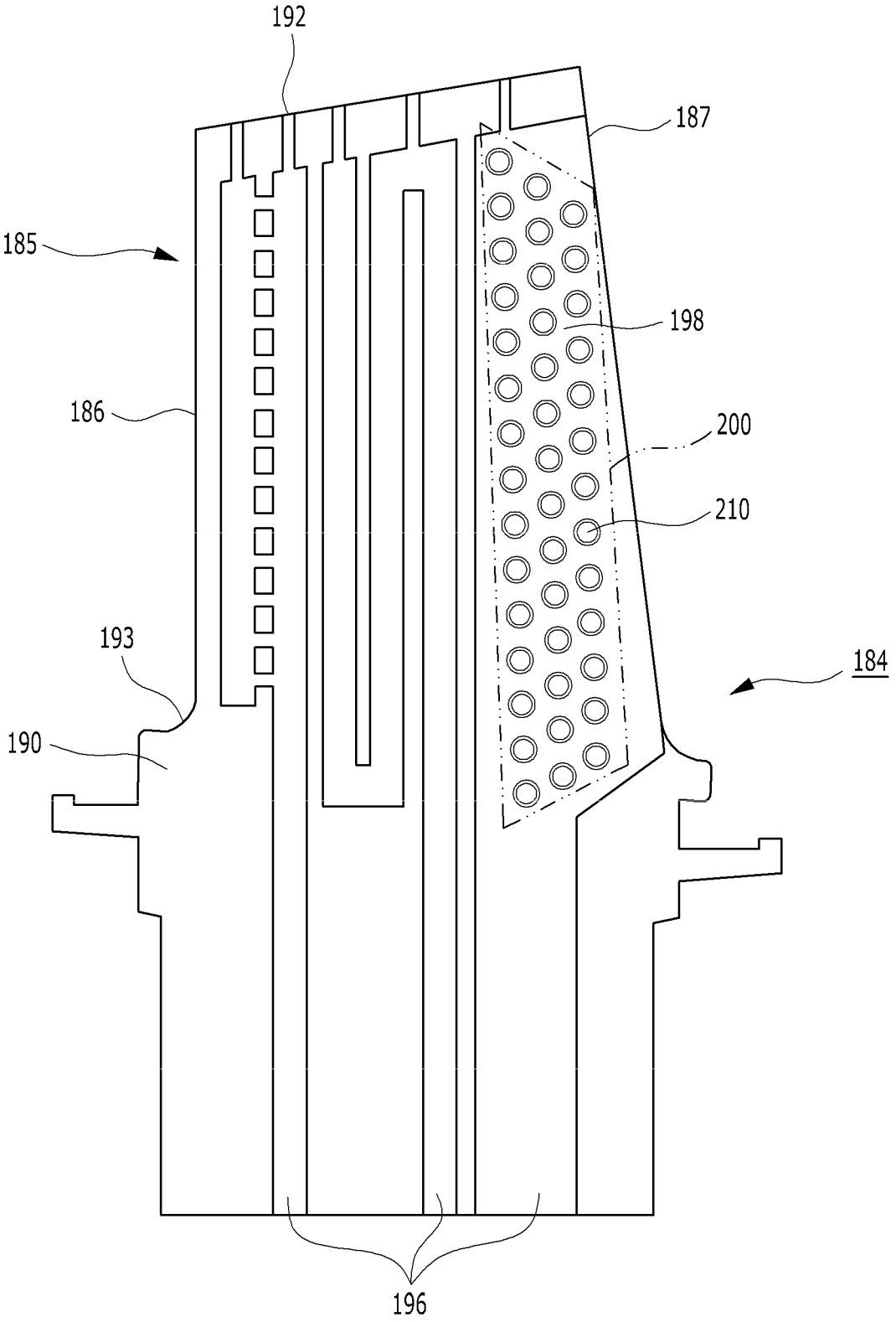
FIG. 2 is a diagram illustrating a cooling structure of a turbine blade according to an exemplary embodiment.
Figure 3A:
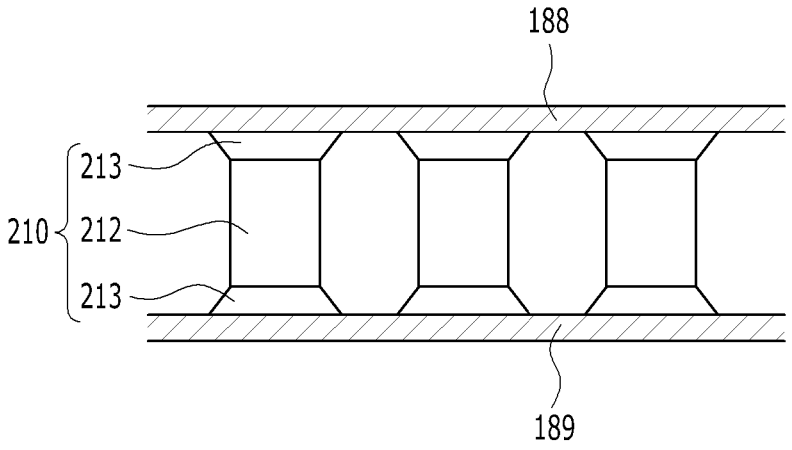
FIGS. 3A and 3B are cross-sectional views illustrating a supporting of a pin-fin included in the turbine blade of FIG. 2.
Figure 3B:
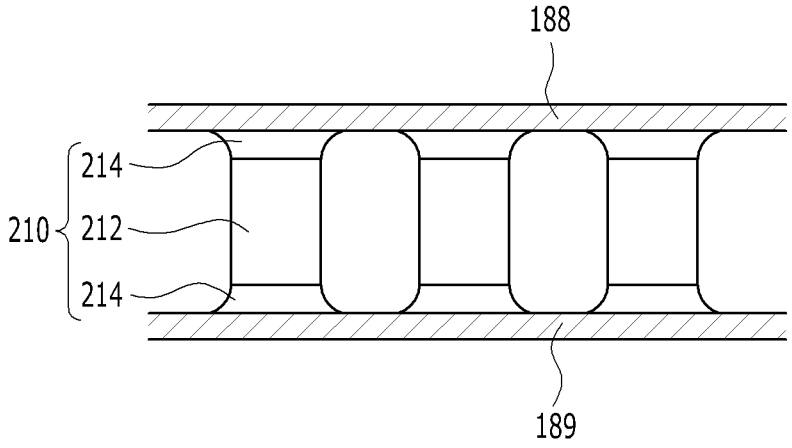
Figure 4:
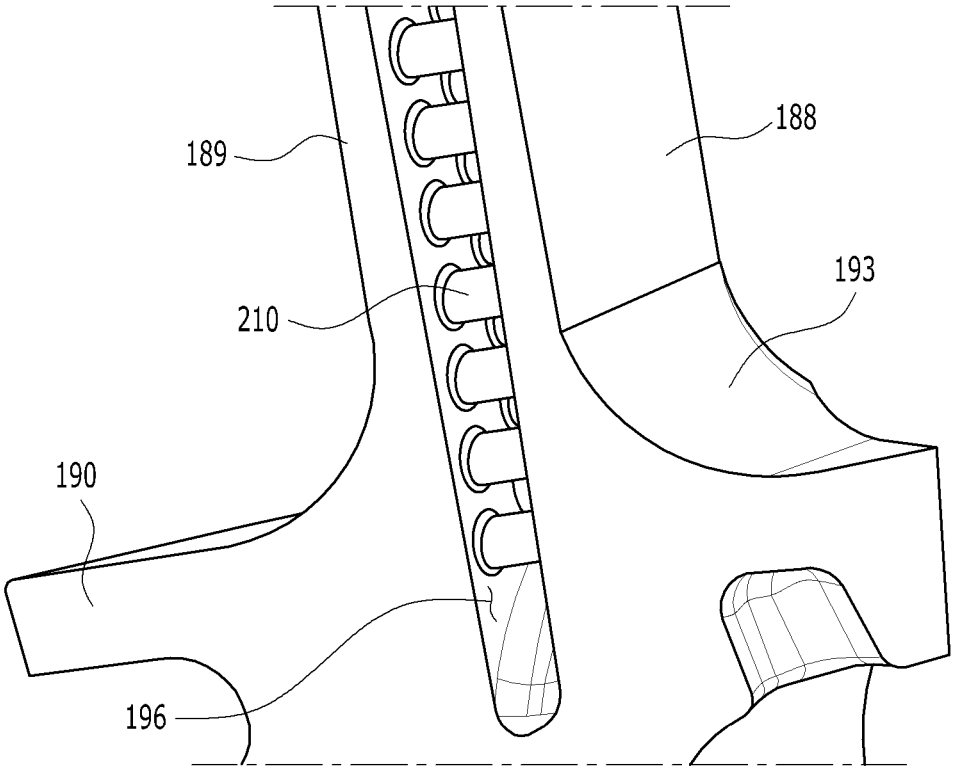
FIG. 4 is a perspective view of a pin-fin array viewed from inside of a cooling passage in a trailing edge of the turbine blade of FIG. 2.

FIG. 2 is a diagram illustrating a cooling structure of a turbine blade according to an exemplary embodiment. FIGS. 3A and 3B are cross-sectional views illustrating a supporting of a pin-fin included in the turbine blade. FIG. 4 is a perspective view of a pin-fin array viewed from inside of a cooling passage in a trailing edge of the turbine blade.

The turbine blade 184 according to an exemplary embodiment has an airfoil-shaped transverse cross section, and extends in a radial direction from a platform 190 to a free end 192 (referred to as a tip). The turbine blade 184 includes a leading edge 186, a trailing edge 187, a pressure side 188 extending from the leading edge 186 to the trailing edge 187 to serve as a first side wall, and a suction side 189 extending from the leading edge 186 to the suction surface 187 to serve as a second side wall.

Referring to FIG. 2, the turbine blade 184 is provided with one or more internal cooling passages 196 along which cooling air flows. For example, the turbine blade 184 may include three internal cooling passages 196 separately disposed in a leading edge region 186, an intermediate region, and a trailing edge region 187, respectively. However, the arrangement or structure of the internal cooling passages is not limited thereto. For example, there may be one serpentine internal cooling passage or four separate internal cooling passages in a blade 185 which is an upper part of the turbine blade 184. The blade 185 is a portion disposed above the platform 190 among the portions of the turbine blade 184.

For example, all of the internal cooling passages 196 may be connected to the trailing edge slot 198 (i.e., cooling slot formed at the trailing edge 187), regardless of the number of the internal cooling passages 196. The trailing edge slot 198 refers to one or more ejection passageways of cooling air, formed at the trailing edge 187, in a manner to extend along or be dispersed in a spanwise direction of the blade 185. The trailing edge slot 198 is formed to intensively cool the trailing edge 187 which is weak in mechanical strength through ejection of cooling air.

Referring to FIGS. 2 through 4, a pin-fin array 200 is provided in each of the cooling passages 196 connected to the trailing edge slot 198. The pin-fin array 200 includes a plurality of pin-fins 210, each of which transversely extends across a corresponding one of the cooling passages 196. That is, each pin-fin 210 is connected between the pressure side 188 and the suction side 189. For example, each pin-fin 210 includes a main body 212 and chamfered portions 213. Alternatively, each pin-fin 210 includes a main body 212 and filleted portions 214. The chamfered portions 213 or the filleted portions 214 are connected to inside surfaces of the pressure side 188 and the suction side 189. The pin-fin array 200 and the turbine blade 184 are a one-piece body formed by a casting process. The chamfered portions 213 or the filleted portions 214 enable molten metal to easily fill die cavities to become the pin-fins 210 during injection of molten metal in the casing process and prevent damage to the pin-fins 210 when removing the die cavities after the injection of molten metal. Because the chamfered portions 213 and the filleted portions 214 prevent concentration of stress, it is preferable to use the chamfered portions 213 or the filleted portions as the supports of the pin-fins 210.

The pin-fins 210 may be used to increase the cooling effect by forming a complex turbulence in the flow of cooling air. An exemplary embodiment may use some of the pin-fins 210-1 through 210-5 among all of the pin-fins 210 of the pin-pin array 200 to improve the structural strength of the trailing edge 187.

The lower end of the turbine blade 184, disposed under the platform 190, is securely fixed to the turbine rotor disk 180 while the upper end of the turbine blade 184 is a free end. Therefore, mechanically, the upper part (i.e., the blade 185) of the turbine blade 184 in the radial direction is considered as a cantilever structure. Because the blade 185 has an airfoil-shaped cross section, middle portion of the blade 185 is relatively thick. Therefore, when the pressure of the combustion gas is applied to the blade 185 to cause warping, stress is concentrated at the middle portion of the fixed end (i.e., base end) of the blade 185 in the vicinity of the platform 190. This concentrated stress has a negative effect on the structural robustness of the blade 185, particularly on the thin trailing edge 187.

Figure 5:
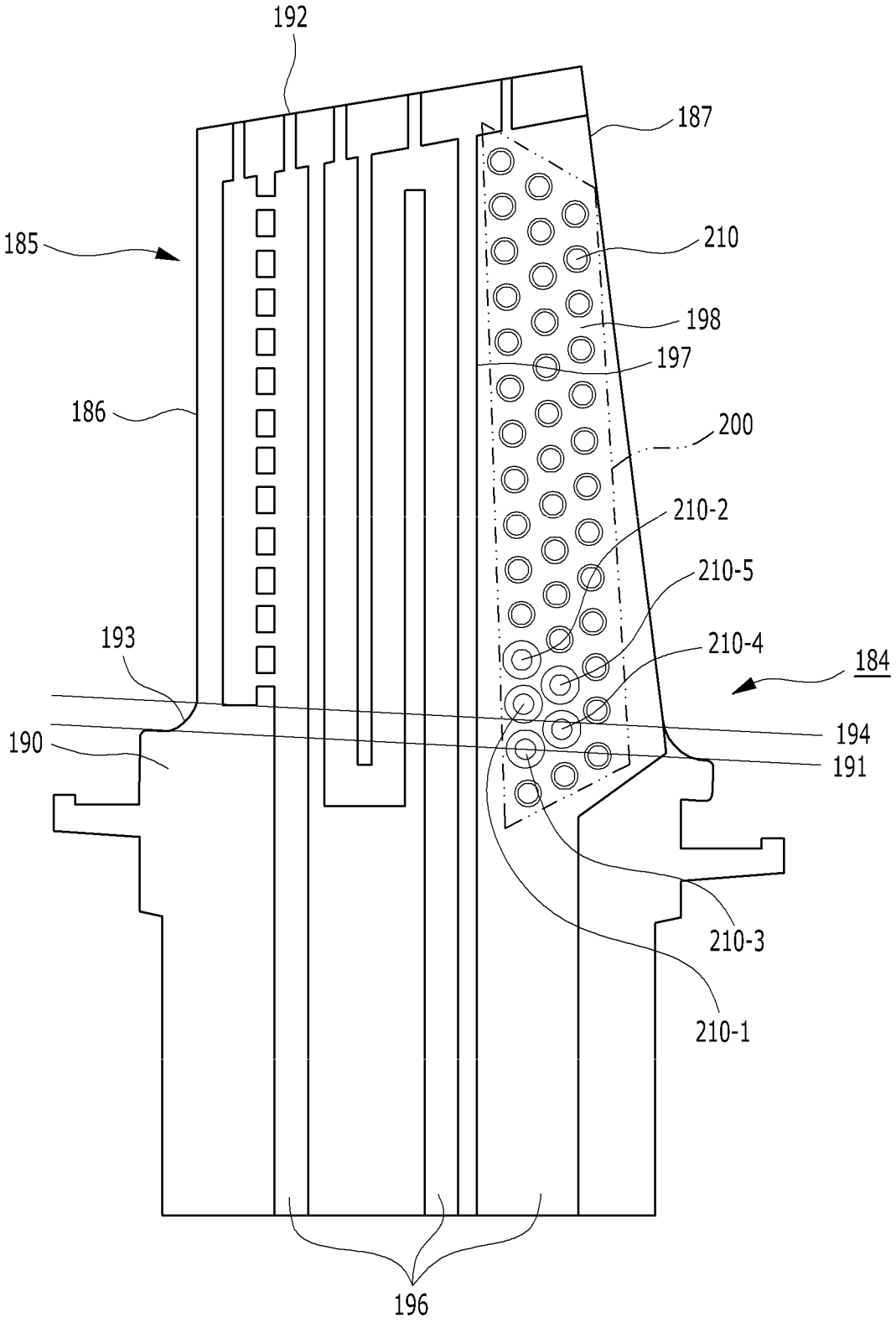
FIG. 5 is a diagram illustrating the internal cooling structure of a turbine blade according to an exemplary embodiment.
Figure 6A:
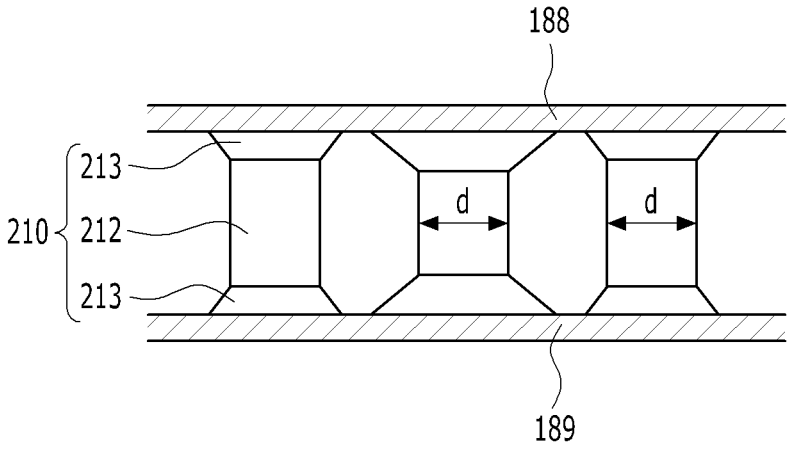
FIGS. 6A and 6B are cross-sectional views illustrating a support of a pin-fin included in the turbine blade of FIG. 5.
Figure 6B:
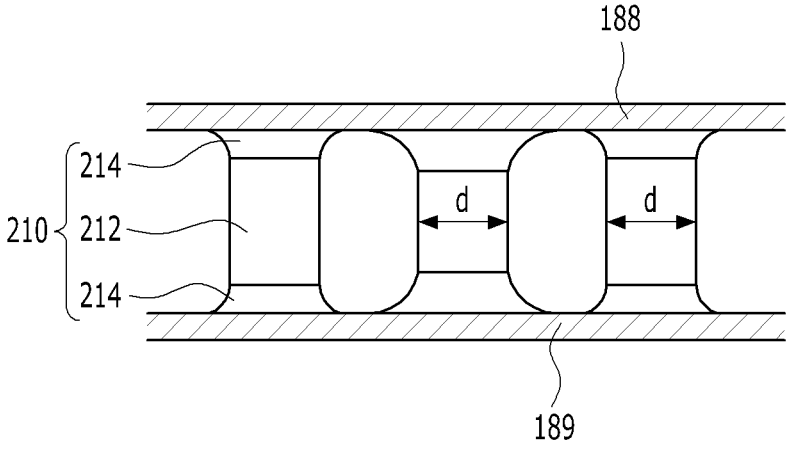
Figure 7:
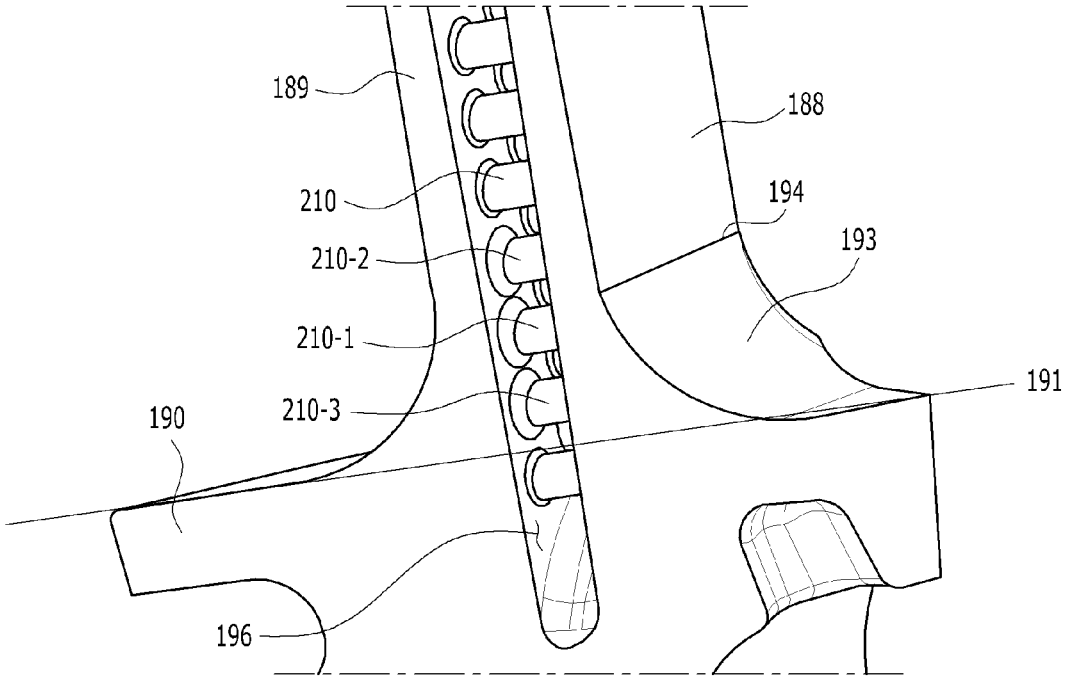
FIG. 7 is a perspective view illustrating a pin-fin array from the inside of a trailing edge of the cooling passage of FIG. 5.

In order to solve the problem of stress concentration, the chamfered portions 213 or the filleted portions 214 of the pin-fins 210-1 through 210-5, which are connected to the inside surfaces of the pressure side 188 and the suction side 189, are formed to be larger than the chamfered portions 213 or the filleted portions 214 of the other pin-fins 210. Hereinafter, exemplary embodiments will be described in greater detail with reference to FIGS. 5 through 7. FIGS. 5 through 7 illustrating the exemplary embodiments respectively correspond to FIGS. 2 to 4 illustrating the related art structure.

Referring to FIGS. 5 through 7, the position of the pin-fins 210-1 through 210-5 having relatively large chamfered portions 213 or relatively large filleted portions 214 may be an inner corner region. The inner corner region refers to a region in which an inside wall surface 197 of the internal cooling passage 196 and an extended line 191 of an upper end of the platform 190 cross each other. That is, the pin-fins 210-1 through 210-5 of the pin-fin array 200 disposed within the region (i.e., the inner corner region in which the inside wall surface 197 of the internal cooling passage 196 and the extended line 191 of the upper end of the platform 190 cross each other) have relatively large chamfered portions 213 or relatively large filleted portions 214 as compared with the other pin-fins 210.

The inside wall surface 197 of the internal cooling passage 196 is a reference position defining the innermost position of the cooling passage 196. That is, the inside wall surface 197 serves as a reference line to define a region within which the pin-fins 210 need to have relatively large chamfered portions 213 or relatively large filleted portions 214 as compared with the remaining pin-fins 210 to solve the problem that the stress is concentrated on a middle portion of a chord of the blade 185.

In addition, the extended line 191 of the upper end of the platform 190 serves as another reference line. A lower portion of the turbine blade 184, disposed below the platform 190, is mechanically strong because it is relatively thick and securely fixed. Thus, the lower portion has no problem in enduring the stress. Therefore, the pin-fins 210 having relatively large chamfered or filleted portions are provided at an upper portion of the turbine blade 184.

As illustrated in FIG. 6, although the pin-fins 210 positioned in the inner corner region have the relatively large chamfered portions 213 or the relatively large filleted portions 214 as compared with the other pin-fins 210, the bodies 212 of the pin-fins 210 positioned within the inner corner region have the same diameter "d" as the bodies 212 of the other pin-fins 210. When cooling air passes the pin-fin array 200, most of the cooling air passes by the bodies 212 of the pin-fins 210. That is, most of the cooling air passes through the center portion of the flow passage. Therefore, if the size of the chamfered portions 213 or the filleted portions 214 of the pin-fins 210 is increased with the size of the bodies 212 of the pin-fins 210 unchanged, the flow behavior of the cooling air is not significantly changed. That is, although the size of the chamfered portions 213 or the filleted portions 214 of the pin-fins 210 is increased, the change in the cooling performance is negligible as long as the diameter d of the bodies 212 of the pin-fins 210 is not changed. Therefore, it is not necessary to redesign the overall arrangement and structure of the pin-fin array 200.

In addition, although the size of the chamfered portions 213 or the filleted portions 214 of the pin-fins 210 is increased, the overall volume increase of the pin-fins 210 is not dramatic, thereby not significantly reducing the size of the air flowing passage. On the other hand, if the size of the chamfered portions 213 or the filleted portions 214 of each pin-fin 210 is increased, because the connection area between the suction side 188 or the pressure side 189 and the corresponding pin-fin 210 is increased, the force of each pin-fin 210 for supporting the pressure side 188 and the suction side 189 is increased. Accordingly, the structure in which a part of the pin-fins 210, i.e., the pin-fins 210 positioned within the inner corner region, are formed to have larger chamfered portions 213 or the filleted portions 214 than the other pin-fins 210 is helpful in cancelling the concentration of stress on the middle portion of the chord of the blade 185 (i.e., the upper part of the turbine blade 184) which is positioned on the platform 190. The range of the size increase of the chamfered portions 213 or the filleted portions 214 may be determined to a range in which the chamfered portions 213 or the filleted portions 214 of the adjacent pin-fins 210 does not interfere with each other.

When determining which pin-fins 210-1 through 210-5 are designed to have relatively large chamfered portions 213 or relatively large filleted portions 214 among the pin-fins 210 positioned within the inner corner region, it is determined according to a predetermined priority. The ordering of the pin-fins to be modified is determined according to the effect. That is, the number of pin-fins to be modified such that the chamfered portions or the filleted portions are increased in size is adaptively determined according to changes in predetermined parameters, and which pin-fins are to be modified is determined according to the predetermined order. Therefore, it is possible to maximize the effect of reducing the concentration of stress with minimal design changes.

A first priority pin-fin 210-1 to be modified such that the chamfered portions 213 or the filleted portions 214 are increased, among the pin-fins positioned on the contact surface between the blade 185 and the platform 190, is a pin-fin positioned nearest a boundary 194 of a fillet 193 of the platform 190 and to the inside wall surface 197 of the cooling passage 196. As the thickness of the fillet 193 is increased, the strength of the blade 185 is increased. That is, among the pin-fins closest to the upper boundary 194 of the fillet 193, which is positioned above the upper boundary 191 of the platform 190, the innermost pin-fin 210-1 is determined as the first priority pin-fin to be modified.

A second priority pin-fin 210-2 to be modified is a pin-fin positioned directly above the first priority pin-fin 210-1. Because the lower boundary 194 of the fillet 193 is closer to the platform 190 than the upper boundary of the fillet, it is structurally stronger than the upper boundary of the fillet. Therefore, the pin-fin 210-2 disposed above the first priority pin-fin 210-1 is determined as the second priority pin-fin 210-2 to be modified, and the pin-fin disposed below the first priority pin-fin 210-1 is determined as a third priority pin-fin 210-3.

The first through third priority pin-fins 210-1, 210-2, and 210-3 are arranged on a first line (i.e., innermost column). The pin-fins, arranged on a second line closer to the trailing edge 187 than the first line, are considered to be the next priority pin-fins to be modified.

A fourth priority pin-fin 210-4 among the pin-fins positioned on the second line (i.e., second column) is a pin-fin closest to the first priority pin-fin 210-1 and the upper boundary 194 of the fillet 193. The pin-fins arranged on the second column are shifted from the respective pin-fins arranged on the first column by a half pitch which equals to the gap between the adjacent pin-fins to enhance the turbulence. There are two second-column pin-fins spaced from the first priority pin-fin 210-1 by an equal distance. In this case, it is effective that the pin-fin closer to the upper boundary 194 of the fillet 193 among the two pin-fins is determined as the fourth pin-fin 210-4.

Based on the same principle on which the second priority pin-fin 210-2 is determined, a fifth priority pin-fin 210-5 is a pin-fin positioned above the fourth priority pin-fin 210-4 among the pin-fins arranged on the second column.

For the ordering of the pin-fins to be determined as the next priority pin-fins 201-2 to 210-5 to be modified such that the chamfered portions 213 or the filleted portions 214 are increased in size, among the pin-fins adjacent to the first priority pin-fin 210-1, various embodiments may be configured. As described above, by modifying only the structure of the supports of the pin-fins 210-1 to 210-5 disposed within the inner corner region, among all the pin-fins of the pin-fin array 200 provided in the cooling passage 196 connected to the trailing edge slot 198, it is possible to improve the mechanical strength of the trailing edge 187 without deterioration of the cooling performance.

While exemplary embodiments have been described with reference to the accompanying drawings, it will be apparent to those skilled in the art that various modifications in form and details may be made therein without departing from the spirit and scope as defined in the appended claims. Therefore, the description of the exemplary embodiments should be construed in a descriptive sense and not to limit the scope of the claims, and many alternatives, modifications, and variations will be apparent to those skilled in the art.

What is claimed is:

1. A turbine blade comprising:

an airfoil blade extending from a platform to a free end and having an airfoil-shaped transverse cross section, the airfoil blade comprising a leading edge, a trailing edge, a pressure side extending from the leading edge to the trailing edge, and a suction side extending from the leading edge to the trailing edge, wherein a fillet connects the airfoil blade and the platform;

one or more internal cooling passages through which cooling air flows;

a trailing edge slot formed along the trailing edge and connected to the one or more internal cooling passages; and a pin-fin array including a plurality of pin-fins positioned in the one or more internal cooling passages connected to the trailing edge slot, each pin-fin including a main body and chamfered or filleted portions respectively connected to the pressure side and the suction side at respective ends of the main body, wherein among the pin-fins of the pin-fin array, a subset of the pin-fins have relatively large chamfered or filleted portions as compared with remaining pin-fins of the pin-fin array, wherein the main bodies of the pin-fins having the relatively large chamfered or filleted portions have a same diameter as the main bodies of the remaining pin-fins, wherein a pin-fin that is closest to an upper boundary of the fillet and closest to an inside wall surface of the one or more internal cooling passages is determined as a first priority pin-fin of the subset of the pin-fins, wherein the subset of the pin-fins having relatively large chamfered or filleted portions is positioned in an inner corner region in which the inside wall surface of the one or more internal cooling passages and an upper boundary of the platform, the upper boundary of the platform being an extended line of an upper end of the platform, cross each other, wherein the upper boundary of the fillet is positioned above the upper boundary of the platform, wherein a pin-fin disposed directly above the first priority pin-fin is determined as a second priority pin-fin of the subset of the pin-fins, and wherein a pin-fin disposed directly below the first priority pin-fin is determined as a third priority pin-fin of the subset of the pin-fins.

2. The turbine blade according to claim 1, wherein the first through third priority pin-fins are arranged on a first column, and among pin-fins of the pin-fin array arranged on a second column adjacent to the first column and disposed on a trailing edge side of the first column, a pin-fin in the second column closest to the first priority pin-fin and closest to the upper boundary of the fillet is determined as a fourth priority pin-fin of the subset of the pin-fins.

3. The turbine blade according to claim 2, wherein among the pin-fins arranged on the second column, a pin-fin disposed directly above the fourth priority pin-fin is determined as a fifth priority pin-fin of the subset of the pin-fins.

4. The turbine blade according to claim 1, wherein a fourth priority pin-fin and a fifth priority pin-fin adjacent to the first priority pin-fin are determined as pin-fins of the subset of the pin-fins.

5. A pin-fin array comprising:

a plurality of pin-fins arranged in a trailing edge slot connected to a cooling passage formed in a turbine blade, each pin-fin being connected to a pressure side and a suction side at respective ends thereof, wherein among the pin-fins of the pin-fin array, a subset of the pin-fins have relatively large chamfered or filleted portions connected to the pressure side and the suction side, respectively, as compared with remaining pin-fins of the pin-fin array, wherein bodies of the pin-fins having the relatively large chamfered or filleted portions have a same diameter as bodies of the remaining pin-fins, wherein a pin-fin that is closest to an upper boundary of a fillet and closest to an inside wall surface of the cooling passage is determined as a first priority pin-fin of the subset of the pin-fins, the fillet connecting an airfoil blade of the turbine blade and a platform of the turbine blade, wherein the subset of the pin-fins of the pin-fin array having relatively large chamfered or filleted portions is positioned in an inner corner region in which the inside wall surface of the cooling passage and an upper boundary of the platform, the upper boundary of the platform being an extended line of an upper end of the platform of the turbine blade, cross each other, wherein a pin-fin disposed directly above the first priority pin-fin is determined as a second priority pin-fin of the subset of the pin-fins, and wherein a pin-fin disposed directly below the first priority pin-fin is determined as a third priority pin-fin of the subset of the pin-fins.

6. The pin-fin array according to claim 5, wherein a fourth priority pin-fin and a fifth priority pin-fin adjacent to the first priority pin-fin are determined as pin-fins of the subset of the pin-fins.

7. The pin-fin array according to claim 5, wherein the first through third priority pin-fins are arranged on a first column, and among pin-fins of the pin-fin array arranged on a second column adjacent to the first column and disposed on a trailing edge side of the first column, a pin-fin in the second column closest to the first priority pin-fin and closest to the upper boundary of the fillet is determined as a fourth priority pin-fin of the subset of the pin-fins.

8. The pin-fin array according to claim 7, wherein among the pin-fins arranged on the second column, another pin-fin disposed directly above the fourth priority pin-fin is determined as a fifth priority pin-fin of the subset of the pin-fins.

* * * * *